United States Patent [19]

Mukerjee

[11] Patent Number: 4,481,782

[45] Date of Patent: Nov. 13, 1984

[54] METHODS AND APPARATUS FOR REFRIGERATING PRODUCTS

[75] Inventor: Ajit K. Mukerjee, Whitehall, Pa.

[73] Assignee: The BOC Group, Inc., Montvale, N.J.

[21] Appl. No.: 460,963

[22] Filed: Jan. 25, 1983

[51] Int. Cl.[3] ..... F25D 13/06

[52] U.S. Cl. ..... 62/63; 34/225; 34/3; 62/374; 62/380; 198/952

[58] Field of Search ..... 62/63, 374, 375, 380; 34/225, 233; 198/952

[56] References Cited

U.S. PATENT DOCUMENTS 3,708,995 1/1973 Berg ..... 62/380

3,841,109 10/1974 Cann ..... 62/380

*Primary Examiner*—Ronald C. Capossela

*Attorney, Agent, or Firm*—David L. Rae; Larry R. Cassett

[57] ABSTRACT

A tunnel refrigeration device includes frame members mounted substantially adjacent to an endless conveyor belt which is utilized to pass products to be refrigerated through the tunnel. The frame members are provided with apertures therein and fan means are mounted in one or more of the apertures so as to pass the tunnel atmosphere into the space between the upper and lower runs of the conveyor belt. Apertures are juxtaposed with each frame mounted fan to enable the tunnel atmosphere passed into this space to be removed therefrom and recirculated upwardly in the tunnel by means of the top mounted fans. Refrigeration is provided to the underside of products on the conveyor belt and the effective capacity of the tunnel may be increased by increasing the capacity of the top mounted fans. The flow of tunnel atmosphere in the space between runs of the conveyor belt substantially precludes the increased downflow of tunnel atmosphere generated by the top mounted fans from rebounding from the tunnel bottom and lifting the products being refrigerated off the conveyor belt.

12 Claims, 4 Drawing Figures

METHODS AND APPARATUS FOR REFRIGERATING PRODUCTS

BACKGROUND OF THE INVENTION

The present invention relates to methods and apparatus for refrigerating products and more particularly to improved, high performance tunnel refrigeration devices.

Tunnel refrigeration devices have been utilized for freezing or chilling products such as food or other materials. Typically, these devices are comprised of an elongated, insulated chamber having an open entrance and exit and an endless belt conveyor extending through the tunnel chamber. The conveyor belt is adapted to receive the product at the tunnel entrance and to pass the same through the tunnel while a refrigerant such as carbon dioxide or liquid nitrogen is introduced into the tunnel to refrigerate the product. The conveyor belt may be comprised of a wire or chain link structure or may take the form of a foraminous belt. The refrigerant is generally introduced into the upper portion of the tunnel and is mixed with the tunnel atmosphere by means of top mounted fans which are effective to also direct the tunnel atmosphere into contact with the product thereby cooling the same. A typical prior art, refrigeration device is illustrated in U.S. Pat. No. 4,086,783.

Another type of tunnel refrigeration device is one in which a plurality of belt runs or "passes" are utilized to translate a product being refrigerated through an enclosed chamber. One such multi-pass tunnel refrigeration apparatus is illustrated in U.S. Pat. No. 3,708,995 which utilizes side mounted fan means for the purpose of developing a helical flow of tunnel atmosphere in a direction substantially transverse and extending vertically across all conveyor surfaces supporting products being refrigerated in the tunnel. A refrigerant supply is introduced into the fans to thereby develop a chilled tunnel atmosphere and these devices do not utilize top mounted fans as described in the refrigeration tunnel hereinabove. In yet another refrigeration apparatus utilizing an endless conveyor belt, products are passed in a spiral pattern through a refrigeration chamber as illustrated in U.S. Pat. No. 3,733,848 which is assigned to the assignee of the present invention. In this spiral freezer, elongated centrifugal fans are mounted vertically in the refrigeration chamber for the purpose of blowing a refrigerated atmosphere over all levels of the spiral conveyor to thereby refrigerate products being passed through the chamber. Again, this device does not utilize top mounted fans nor the introduction of a refrigerant downwardly onto products being passed through the refrigeration chamber.

While the above-described refrigeration tunnels are generally effective to refrigerate products, the rate at which products can be refrigerated to a desired extent is limited and cannot be readily increased without extensive structural changes. For example, increasing conveyor belt speed will accelerate the rate of passing product through the tunnel device, but unless sufficient heat is removed from the tunnel in a shorter period of time, simply increasing belt speed will not assure that a product is refrigerated to a desired extent. In addition, although the rate of introduction of refrigerant into a tunnel may be increased, it is necessary to increase the capacity (i.e. speed and bladesize) of the top mounted fans to assure that the refrigerant and tunnel atmosphere are mixed to thereby sublime or vaporize the refrigerant as it is important to preclude the refrigerant, such as $CO_2$ snow, from being carried out of the tunnel with the product which, in turn, results in more efficient utilization of the refrigerant. However, it has been found that attempts to increase fans capacity to accommodate a greater flow of refrigerant will increase the downward velocity of the tunnel atmosphere generated by the top mounted fans which in turn results in this atmosphere rebounding from the bottom of the tunnel upwardly through the conveyor belt and actually lifting the product off the conveyor belt as it is being passed through the tunnel. This effect of lifting product is particularly noticeable during the accelerated freezing of products such as hamburger patties and as a consequence, patties can be actually thrown from the belt and disfigured so that a product of unacceptable configuration and appearance is discharged from the tunnel freezer. Similarly, it has not been feasible to increase the throughput or capacity of tunnel refrigeration devices without extensive structural modifications such as increasing conveyor belt length or area. However, these modifications are expensive and significantly increased the capital cost of tunnel refrigeration devices. Thus, there is a clear need for improved tunnel refrigeration devices which enable a greater rate of refrigerating product to a desired extent yet do not require increased tunnel belt lengths or other major structural modifications.

OBJECTS OF THE INVENTION

It is an object of the invention to provide improved methods and apparatus for refrigerating products.

It is another object of the invention to provide improved tunnel refrigeration devices.

It is yet another object of the invention to provide improved tunnel refrigeration devices wherein higher rates of refrigerating products can be obtained without increasing the conveyor belt length of such tunnels.

It is still another object of the present invention to provide improved tunnel refrigeration devices wherein the refrigeration provided to the underside of product on a conveyor belt is increased.

It is a further object of the present invention to provide a tunnel refrigeration apparatus wherein improved flows of tunnel atmosphere are developed therein to enable higher rates of refrigeration to be obtained.

Other objects of the invention will become apparent from the detailed description of the invention taken in consideration of the drawing.

SUMMARY

In accordance with the invention tunnel refrigeration apparatus having an endless conveyor belt mounted therein and top mounted mounted fans are provided with further fan means mounted substantially adjacent to and between the upper and lower conveyor belt runs and effective to pass at least the majority of the flow of the tunnel atmosphere generated by such further fans means into the space between conveyor belt runs to provide increased refrigeration to the underside of products on the upper belt run. The further fan means are typically comprised of relatively small fans mounted in apertures in frame members extending along and adjacent to the conveyor belt. Juxtaposed with each fan means is a further aperture which enables the tunnel atmosphere introduced into the space between upper and lower conveyor belt runs to be removed and recirculated in the tunnel by means of the top mounted fans.

Preferably, each frame member is provided with a plurality of such apertures with fans being disposed in alternate apertures of each frame member.

As a consequence of directing a flow of tunnel atmosphere into the space between conveyor belt runs, increased refrigeration is provided to the underside of products being passed through the tunnel and consequently, less time is required to refrigerate such products to a desired extent. In this manner, the capacity or through put of a refrigeration tunnel in accordance with the invention is increased. In addition to this benefit, the introduction of tunnel atmosphere into the space between conveyor belt runs has a further important effect in that this flow tends to interact with the downflow of tunnel atmosphere generated the top mounted fan means. As a result of this interaction, the capacity of such fans means may be increased without resulting in the downflow of tunnel atmosphere rebounding from the tunnel bottom and lifting product off the conveyor belt. Thus, the effect of increasing the capacity of the top mounted fan means in conjunction with operation of the side mounted fan means results in a greater action of holding product on the conveyor belt as opposed to lifting the same therefrom and permits additional refrigerant to be introduced into the tunnel device without resulting in refrigerant leaving the tunnel without yielding its refrigeration. Thus, the device according to the invention will enable product to be passed through the freezer at a greater rate and yet be refrigerated to a desired extent without disfiguring or otherwise impairing the shape or appearance of the product. In this respect, the invention constitutes a significant improvement in tunnel refrigeration devices and enables increased throughput for a device of a given conveyor belt length yet without requiring significant structural modifications to the device.

BRIEF DESCRIPTION OF THE DRAWING

The invention will be more clearly understood by reference to the following description of exemplary embodiments thereof in conjunction with the following drawing in which.

DESCRIPTION OF PREFERRED EMBODIMENTS

Before describing the method and apparatus according to the invention in detail, it is believed helpful to define certain terms used herein. For example, the term "product" may comprise of food or non food items. It has been found that the present invention is particularly useful in refrigerating food such as hamburger patties. The term "refrigerate" will be understood to mean either freezing, chilling or "crust" freezing of particular items. The term "tunnel atmosphere" shall be understood to mean essentially air mixed with the refrigerant such as carbon dioxide or liquid nitrogen introduced into the tunnel. The "refrigerant" shall be understood to mean a liquefied gas such as liquid carbon dioxide or liquid nitrogen or any other suitable material which may be utilized to reduce the temperature of a product being passed through a tunnel.

Figure 1:
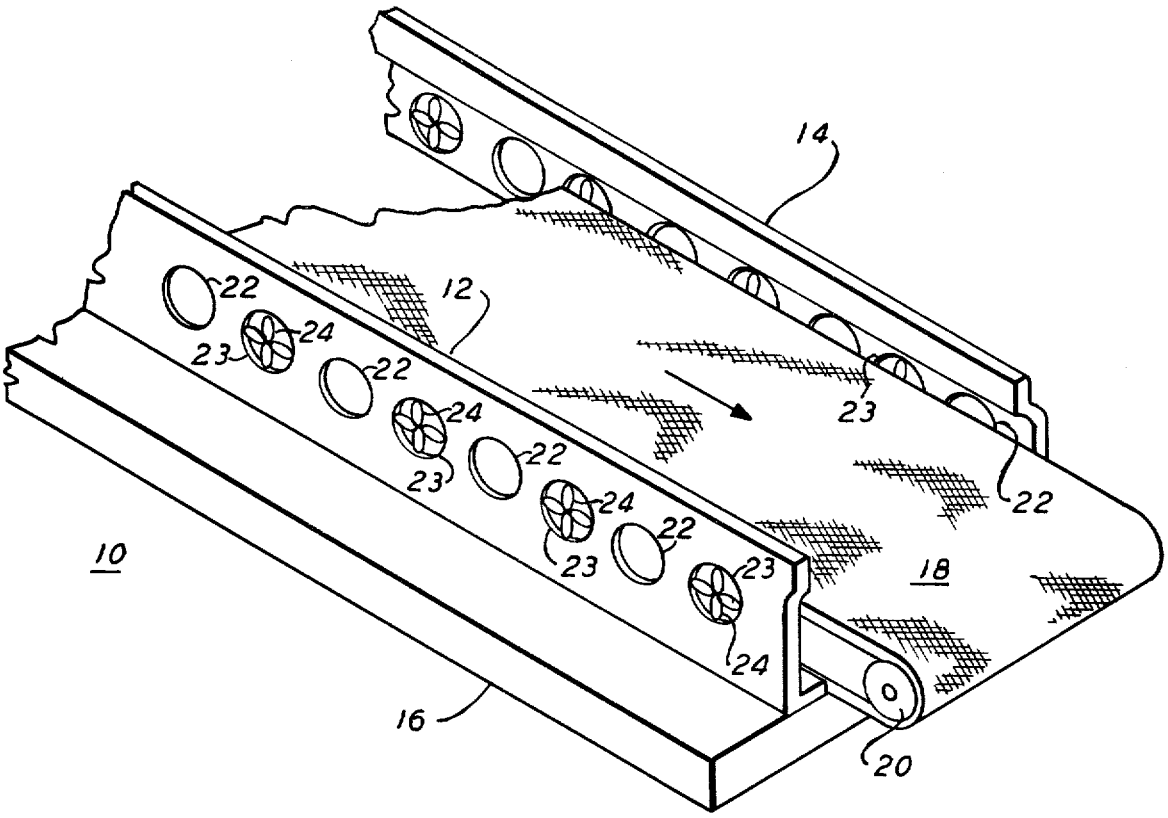
FIG. 1 is a partial isometric view of a refrigeration tunnel according to the invention.

Referring now to FIG. 1 of the drawing, illustrated therein is an exemplary embodiment of apparatus 10 according to the invention. A portion of the structure of a typical tunnel refrigeration device, namely bottom portion 16, conveyor belt 18, and drive means 20 are illustrated in FIG. 1. Bottom portion 16 may comprise an insulated member disposed below conveyor belt 18 and bottom portion 16 may be mounted on legs (not shown) and portion 16 may be movably mounted on such legs to enable cleaning of the tunnel apparatus 10. Conveyor belt 18 may take the form of a wire link belt which essentially permits the flow of tunnel atmosphere therethrough yet supports products to be refrigerated as the same are passed through the tunnel device. Drive means 20 may take the form of any suitable element such as a sprocket wheel or the like which is driven by a motor and gear arrangement not shown in a manner known to those skilled in the art. Conveyor 18 may, for example, be driven in the direction of the arrow shown thereon.

In accordance with the invention, frame members 12 and 14 are mounted on bottom portion 16 essentially along the length of conveyor belt 18 as illustrated in FIG. 1. It will be understood that suitable guide means (not shown) such as rollers in tracks or the like may be utilized with frame members 12 and 14 to provide additional support to conveyor belt 18 along the edges thereof. More particularly though, each of frame members 12 and 14 is provided with sets of apertures 22 and 23 which are preferably of a diameter approximately equal to or less than the vertical spacing between upper and lower runs of conveyor belt 18 and are located such that the top and bottom points of such apertures essentially coincide with the upper and lower runs of conveyor belt 18. Accordingly, the diameter of each of fans 24 is less than or substantially equal to the spacing between the upper and lower runs of conveyor belt 18. By so sizing fans 24, the tendency of these fans to lift product off conveyor belt 18 is substantially precluded. As illustrated in FIG. 1, fans 24 are mounted for rotation in apertures 23 which in turn are alternately spaced in frame members 12 and 14 with respect to apertures 22. Each of apertures 22 in one frame member are substantially juxtaposed with a corresponding aperture 23 in the other frame member such that tunnel atmosphere introduced by fan 24 into the space between the upper and lower conveyor belt runs may exit therefrom through an aperture 22 in the opposed frame member. Fan means 24 are of relatively low capacity in comparison with top fan means 26, 28, and 30 (FIG. 2) and are preferably disposed in apertures 23 alternately with apertures 22 in each frame member as illustrated in FIG. 1. However, in certain circumstances, it may not be necessary to dispose such fan means 24 in an alternate configuration as illustrated in FIG. 1.

Figure 2:
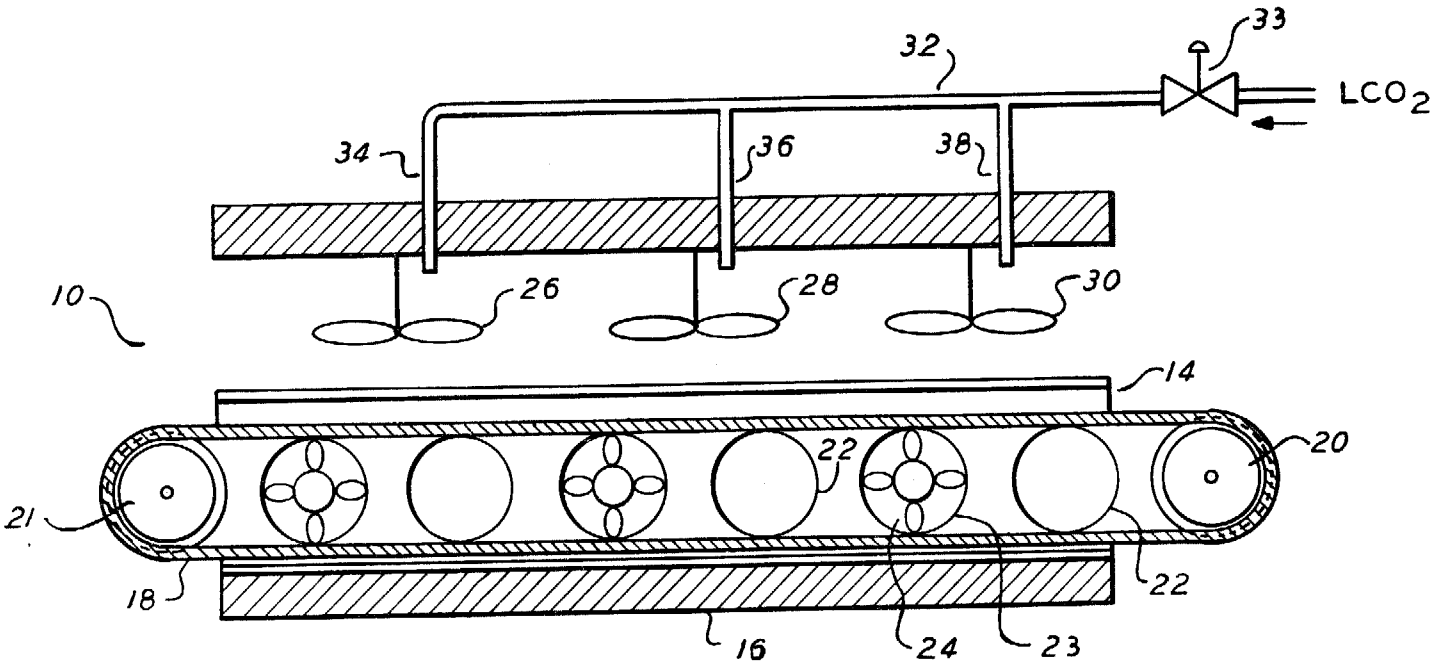
FIG. 2 is a partial elevational diagramatic view of a refrigeration tunnel according to the invention.

FIG. 2 depicts, in addition to the structure illustrated in FIG. 1, an additional embodiment of structure including an end or idler roll or sprocket 21 which cooperates with drive means 20 in order to translate conveyor belt 18 through tunnel apparatus 10. As mentioned previously, top mounted fan means 26, 28 and 30 may be provided and are typically mounted from insulated top portion 17 of tunnel apparatus 10. In addition, a supply of refrigerant, e.g. liquid $CO_2$, may be introduced through conduit 32 and subsequently and through conduits 34, 36 and 38 into the upper reaches of tunnel apparatus 10. A suitable control valve 33 (or a plurality of control valves) is preferably provided in line 32 to enable the flow of refrigerant to be controlled in response to temperature established within tunnel apparatus 10 by means of control techniques known to those skilled in the art. As illustrated in FIG. 2, liquid $CO_2$ is discharged through conduits 34, 36 and 38 into the vicinity of top mounted fans 26, 28 and 30, respectively and upon such discharge forms a mixture of solid and gaseous $CO_2$ which is circulated about the interior of tunnel apparatus 10 thereby reducing the temperature therein. Top mounted fans 26, 28 and 30 are effective to direct a stream of refrigerated tunnel atmosphere downwardly toward the upper run of conveyor belt 18 to enable products thereon to be refrigerated. Preferably, top mounted fans 26, 28 and 30 operate at a capacity such that the mixing of solid $CO_2$ and the tunnel atmosphere is such as to sublime solid $CO_2$ prior to contact with products being refrigerated so that little or no solid $CO_2$ will build up on conveyor belt 18 or on products thereon. This will avoid solid $CO_2$ from being carried out of tunnel 10. As mentioned previously, fan means 24 are mounted for rotation in apertures 23 in an alternate configuration with respect to apertures 22 of frame member 14. It will be understood however that, if desired, fan means 24 may be mounted in a location spaced away from frame member 14 although in this instance, it would be desirable to provide a suitable duct or shroud so as to direct the flow generated by the fan means 24 through aperture 23 into the space between upper and lower runs of conveyor belt 18.

Figure 4:
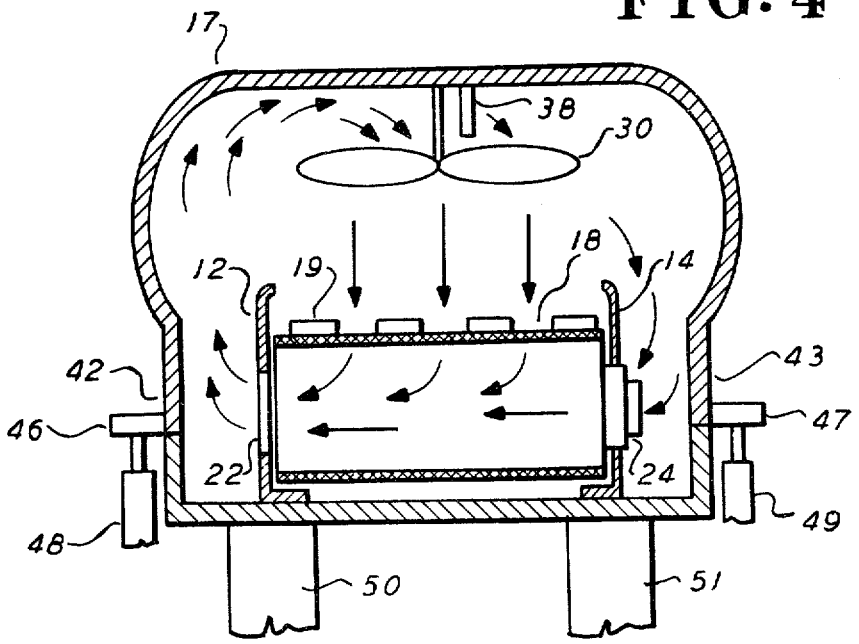

The tunnel apparatus according to the invention illustrated in FIG. 4 will now be described. As illustrated in FIG. 4, top, portion 17 is provided with two upper curved side sections and lower vertical side sections 42 and 43. The side sections of top portion 17 are curved concavely with the extremities or ends of the blade of top mounted fan 30. In addition, suitable support members or shoulders 46 and 47 extend from side sections 42 and 43 respectively to enable the entire top portion 17 to be raised by means of hydraulic cylinders 48 and 49. By operation of cylinders 48 and 49, access may be gained to conveyor belt 18 to enable cleaning and maintenance operations to be performed. Bottom portion 16 is supported by legs 50 and 51 or other suitable means. It will be understood, however, that other means for separating top portion 17 from bottom portion 16 may be employed.

Figure 3:
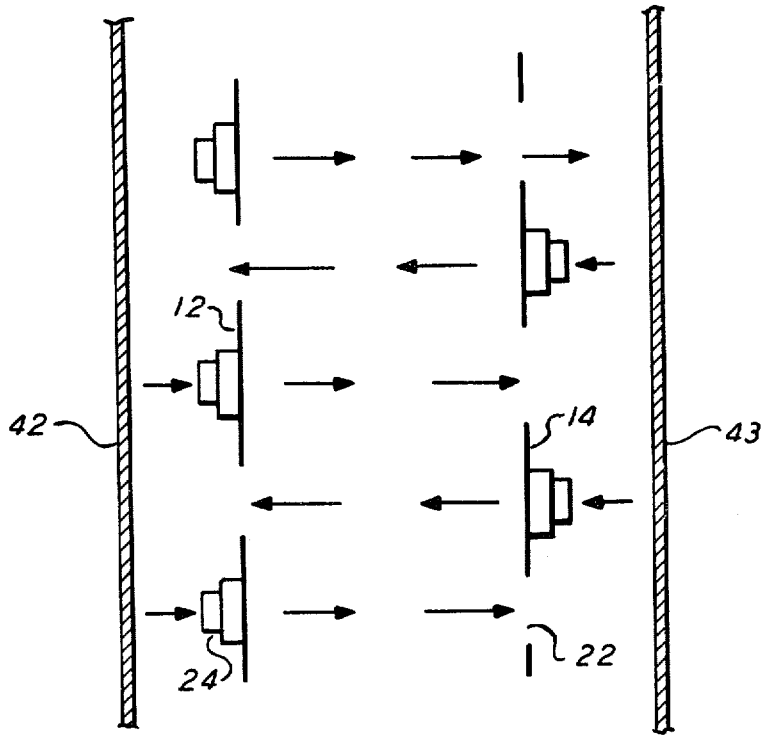
FIGS. 3 and 4 are diagramatic views of flows of tunnel atmosphere resulting during operation of tunnels in accordance with the present invention.

The flow of tunnel atmosphere in the apparatus illustrated in FIGS. 3 and 4 will now be described. In FIG. 3, the flow of tunnel atmosphere is shown as substantially horizontally through the space between runs of the conveyor belt as depicted. Each of fans 24, which are disposed alternately with apertures 22 in each frame member 12 and 14, is effective to draw tunnel atmosphere from the space between each frame member and side wall 42 or 43 and introduce such atmosphere into the space between runs of conveyor belt 18 as illustrated by the arrows in FIG. 3. The aperture 22 juxtaposed with each fan 24 is effective to enable the removal of tunnel atmosphere from the space between runs of conveyor belt 18.

Referring now to FIG. 4, the combined flow of tunnel atmosphere generated by top mounted fan 30 in combination with the refrigerant supplied into the tunnel apparatus by means of conduit 38 is depicted. In addition, the flow of tunnel atmosphere produced by fan means 24 is also shown. In accordance with the invention, top mounted fan 30 is effective to generate a downflow of tunnel atmosphere toward the upper run of conveyor belt 18 and this flow will pass through portions of the upper run not occupied by a product 19 being refrigerated. In addition, fan means 24 is effective to draw tunnel atmosphere from the space between such fan means and a tunnel side wall such as wall 43 as illustrated in FIG. 4 and pass at least the majority, and preferably substantially all of, such atmosphere through frame member 14 into the space between runs of conveyor belt 18. This atmosphere will mix with the downflow of tunnel atmosphere generated by fan 30 and will essentially exit from the space between conveyor runs through aperture 22 of frame member 12 and will be directed upwardly against side wall 42 for recirculation beneath top portion 17. By providing top portion 17 with outwardly curved surfaces, there will be sufficient space between the ends of fan blades 30 and these surfaces such that tunnel atmosphere will be recirculated and fan blades 30 will not be "starved" of tunnel atmosphere.

The operation of the apparatus according to the invention will now be described with particular reference to the structure illustrated in FIG. 4. Initially, conveyor 18 and top fan 30 (and fans 26, 28, etc.) and frame mounted fans 24 are actuated and a refrigerant is supplied into apparatus 10 through conduit 38, etc. in order to cool the tunnel down to a desired initial temperature. Product 19 is then placed on conveyor belt 18 and is passed through the tunnel and is refrigerated therein to a desired extent. The top fan 30 is effective to generate a downflow of tunnel atmosphere which is comprised of the refrigerant supplied thereto mixed with the ambient atmosphere within the tunnel and this downflow is effective to both refrigerate product 19 and to hold the same on the upper run of conveyor belt 18. Fan means 24 are effective to draw tunnel atmosphere and pass the same into the space between runs of conveyor belt 18 as generally illustrated in FIG. 4. This flow of tunnel atmosphere is in a direction generally transverse to the direction of translation of conveyor belt 18 and is effective to provide refrigeration to the underside of product 19. In this manner, a greater degree of heat transfer, i.e. extraction of heat is effected with respect to product 19 which is thereby more rapidly refrigerated to a desired extent. In addition, and importantly, the flow of tunnel atmosphere generated by fan means 24 is effective to interact with and mix with the downflow of tunnel atmosphere produced by top fan 30 such that this downflow is substantially precluded from contacting the bottom portion 16 of the tunnel and rebounding upwardly through both runs of the conveyor belt. As a consequence of this interaction between transverse flow and downflow of tunnel atmosphere, such rebounding is substantially, if not almost entirely, dissipated and product 19 is not lifted or removed upwardly from conveyor belt 18. The tunnel atmosphere which exits the space between runs of conveyor belt 18 through aperture 22 is drawn upwardly as generally illustrated in FIG. 4 and is recirculated under the influence of top fan 30 thereby enabling a desired movement of tunnel atmosphere to be achieved and maximize the heat transfer, i.e. extraction of heat, with respect to product 19.

The tunnel refrigeration apparatus according to the invention enables higher performance in terms of the ability of a tunnel of a given conveyor belt length to refrigerate a product to a desired extent. This means, for example, that a greater weight of product can be frozen in a particular time period by a tunnel of a particular conveyor belt length. As mentioned previously, prior art refrigeration tunnels are limited in that attempts to increase the capacity of top mounted fans tends to result in product being lifted off the conveyor belt as the downflow of tunnel atmosphere will rebound upwardly from the bottom of the tunnel. This effect is substantially obviated by use of apparatus according to the invention in that the interaction of a transverse flow of air generated by fan means 24 precludes this upflow of tunnel atmosphere occurring from beneath the runs of conveyor belt 18. Consequently, the speed of top mounted fan 30 and the rate of refrigerant supplied through conduit 38 may be increased without resulting in product being lifted off conveyor belt 18. Accordingly, greater degree of refrigeration may be supplied to a tunnel of a given length in accordance with the invention than has heretofore been possible in typical prior art tunnels and consequently, conveyor belt 18 may be translated at a greater speed and yet still refrigerate product to a desired extent while maintaining such product thereon. Thus, a greater degree of cooling per unit of belt length is attained by the present invention which in turn effectively shortens the length of a tunnel required to refrigerate a given throughput (pounds per hour) of product. Conversely, in accordance with the invention, a tunnel of the same length as a prior art tunnel can refrigerate a greater weight of product per unit of time while incurring relatively little capital cost additions, mostly in the form of fan means 24 mounted in frame members 12 and 14.

Apparatus according to the invention has been experimentally tested to determine the increased performance obtainable from utilization of frame mounted fans. The particular freezing tunnel utilized had 6 top mounted fans and 16 frame mounted fans with each of the latter having a diameter of 9 inches. The conveyor belt run length was 20 feet and the width was 30 inches. In each of the following tests, one-quarter lb. hamburger patties were frozen in the tunnel by attaining a tunnel temperature of −80° F. and driving the conveyor belt such that the patties had a residence time of 3 minutes, 15 seconds. Frame mounted fans were operated only during Test A.

| Test A | | Test B | |
|---|---|---|---|
| Pattie inlet temp. | = 32° F. | Pattie inlet temp. | = 32° F. |
| Pattie temp. out | = 0.5° F. | Pattie temp. out | = 26.8° F. |
| BTU removal per lb. | = 109.5 | BTU removal per lb. | = 67.2 |

Thus, the BTU removal rate of Test A was 63% greater than the equivalent rate for Test B which is considered exemplary of the improved performance of freezing tunnels according to the invention.

It has been found that the time required to refrigerate a given weight of product such as hamburger patties in accordance with the present invention can be reduced by up to 50% or more in comparison with prior art tunnels of equivalent belt length. In sum, the present invention results in tunnel refrigeration apparatus having greater and better located tunnel atmosphere flows which are thus available to transfer refrigeration more effectively and rapidly to a product. Consequently, tunnel refrigeration apparatus according to the invention enables higher performance in terms of product throughput rates than can be attained from prior art tunnnel devices of equivalent belt length and area.

The foregoing and other various changes in form and details may be made without departing from the spheres and scope of the present invention. Consequently, it is intended that that the appended claims be interpreted as including all such changes and modifications.

I claim:

1. Tunnel refrigeration apparatus having a bottom portion disposed below an endless conveyor belt comprised of upper and lower spaced apart belt runs for passing products to be refrigerated through said tunnel; top mounted fan means for mixing a refrigerant introduced into said tunnel with the tunnel atmosphere and directing the mixture substantially downwardly toward said upper belt run, the improvement comprising fan means mounted in said tunnel substantially adjacent to said belt runs and adapted to pass at least the majority of the flow generated by said fan means into the space between said belt runs to thereby provide refrigeration to the underside of products on said upper belt runs and to substantially preclude said downflow of tunnel atmosphere from rebounding upwardly from said bottom portion toward said upper belt run.

2. The apparatus defined in claim 1 wherein said fan means are adapted to pass substantially all of the flow generated thereby into said space between said belt runs.

3. The apparatus defined in claim 1 additionally comprising means for removing said flow from said space between belt runs.

4. The apparatus defined in claim 1 additionally comprising elongated frame members disposed substantially adjacent to and on both sides of said space between said belt runs and wherein said fan means are mounted on said frame members.

5. The apparatus defined in claim 4 wherein said frame members are provided with apertures therein with each of said fan means being mounted in an aperture in one frame member and substantially juxtaposed with a corresponding aperture of the other frame member.

6. The apparatus defined in claim 4 wherein said tunnel includes a top portion for supporting said top mounted fan means and a bottom portion below said lower belt run with the downflow of tunnel atmosphere generated by said top mounted fan means being mixed with said flow produced by said fan means in said space between said belt runs such that said downflow is substantially precluded from rebounding from said bottom portion toward said upper belt run.

7. The apparatus defined in claim 6 wherein the top portion includes a section which is curved concavely with respect to said top mounted fan means thereby increasing the distance between the extremities of said fan means and said top portion.

8. The apparatus defined in claim 5 wherein said fan means are mounted in alternate apertures of each of said frame members.

9. The apparatus defined in claim 8 wherein the flow of tunnel atmosphere generated by one of said fan means mounted in one frame member is passed in a direction substantially opposed to the direction of the flow of tunnel atmosphere generated by the fan means juxtaposed with the aperture adjacent the fan means in said one frame member.

10. A method of refrigerating a product which includes passing said product through a tunnel device on an endless conveyor having a spaced apart upper and lower belt runs, introducing a refrigerant into said tunnel device and mixing said refrigerant with said tunnel atmosphere to cool the same directing said cooled tunnel atmosphere downwardly into contact with said product and through the upper run of said conveyor belt, the improvement comprising the steps of forming a further flow of said tunnel atmosphere and passing substantially all of said further flow into said space between said belt runs to substantially dissipate the vertical component of said downwardly directed flow of tunnel atmosphere.

11. The method defined in claim 10 wherein said step of passing said further flow comprises passing substantially all of said further flow in to said space between said belt runs.

12. The method defined in claim 10 additionally comprising the steps of removing said tunnel atmosphere from said space between said belt runs said recirculating said removed flow into contact with products on the upper runs of said conveyor belt.

* * * * *